US008483602B2

(12) United States Patent
Hullman et al.

(10) Patent No.: US 8,483,602 B2
(45) Date of Patent: Jul. 9, 2013

(54) METHOD FOR ENLARGING TONER TRANSFER WINDOW IN EP IMAGING DEVICE AND TRANSFER STATION EMPLOYING THE METHOD

(75) Inventors: David William Hullman, Lexington, KY (US); Brandon Alden Kemp, Lexington, KY (US); Niko Jay Murrell, Lexington, KY (US); Ryan James Nelson, Versailles, KY (US); Julie Ann Gordon Whitney, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 566 days.

(21) Appl. No.: 12/562,341

(22) Filed: Sep. 18, 2009

(65) Prior Publication Data

US 2011/0070000 A1 Mar. 24, 2011

(51) Int. Cl.
*G03G 15/16* (2006.01)

(52) U.S. Cl.
USPC ..... 399/313

(58) Field of Classification Search
USPC ..... 399/302, 308, 313, 303
See application file for complete search history.

(56) References Cited

U.S. PATENT DOCUMENTS

| | | | | |
|---|---|---|---|---|
| 5,321,476 | A * | 6/1994 | Gross | 399/66 |
| 5,732,311 | A | 3/1998 | May et al. | |
| 6,081,685 | A * | 6/2000 | Umetani et al. | 399/303 |
| 6,801,741 | B2 * | 10/2004 | Enomoto et al. | 399/302 |
| 7,347,808 | B2 | 3/2008 | Beach et al. | |
| 2007/0075296 | A1 | 4/2007 | DeJesus et al. | |
| 2007/0280748 | A1 | 12/2007 | Yoshida | |
| 2009/0142083 | A1 * | 6/2009 | Minbu | 399/45 |
| 2011/0044733 | A1 | 2/2011 | Blair et al. | |

OTHER PUBLICATIONS

Final Office Action for U.S. Appl. No. 12/544,650, dated Mar. 16, 2012.

* cited by examiner

*Primary Examiner* — Quana M Grainger

(57) ABSTRACT

A transfer station for toner transfer in an electrophotographic imaging device includes an endless transfer belt transported about an endless path through the imaging device, a transfer roll adjacent one surface of the transfer belt, and a backup roll adjacent an opposite surface of the transfer belt opposite from the transfer roll such that the transfer roll and backup roll form a transfer nip effecting transfer of toner. For the purpose of improved overtransfer performance, an outer layer of a thin polymer coating is applied to at least one of the transfer belt and the rolls so as to be located within the transfer nip with transfer of toner. The polymer layer has a thickness from about 5 μm to about 200 μm, surface resistivity from about 1E08 to about 1E12 Ohm/cm and breakdown strength greater than 500 V.

13 Claims, 1 Drawing Sheet

METHOD FOR ENLARGING TONER TRANSFER WINDOW IN EP IMAGING DEVICE AND TRANSFER STATION EMPLOYING THE METHOD

CROSS REFERENCES TO RELATED APPLICATIONS

This patent application is related to the subject matter of co-pending U.S. patent application Ser. No. 12/544,650, filed Aug. 20, 2009, assigned to the assignee of the present invention. The entire disclosure of this patent application is hereby incorporated herein by reference.

BACKGROUND

1. Field of the Invention

The present invention relates generally to electrophotographic (EP) imaging devices and, more particularly, to a method for enlarging a transfer window in an EP imaging device for toner transfer and also to a transfer station employing the method in which a layer of a thin polymer coating with high dielectric breakdown strength applied to a transfer nip defining element improves transfer efficiency and print quality.

2. Description of the Related Art

An electrophotographic (EP) imaging device uses electrostatic voltage differentials to promote the transfer of toner from component to component. During the transfer process, the toner is moved from a donating medium like a photoconductor or a transfer belt to an accepting medium, for example a belt or final media such as paper. Transfer is a core process in the entire EP printing process. The process starts when a photosensitive roll, a photoconductor, is charged and then selectively discharged to create a charge image. The charge image is developed by a developer roll covered with charged toner of uniform thickness. This developed image then travels to the first transfer process or the only transfer process in the case of direct-to-paper systems.

At first transfer the toner forming the developed image enters a nip area formed by a photoconductor roll and a transfer roll. The media for the toner to be transferred to is either a transfer belt or a transport belt supporting paper which is in between these two rolls. Time, pressure and electric fields are all critical components of the quality of the transfer process. A voltage is applied to the transfer roll to pull charged toner off the photoconductor onto the desired medium. In a two transfer system the transfer belt, now carrying the charged toner travels to a second transfer nip, similar in many ways to the first transfer nip. Again the toner is brought into contact with the medium, which it must transfer to in a nip formed by several rolls. Typically a conductive back up roll and a resistive transfer roll make up the two primary sides of the nip. As with first transfer; time, pressure and applied fields are important for high efficiency transfer.

Transfer robustness is frequently measured as the amount of voltage between the lowest voltage where acceptable transfer occurs because sufficient electric field has been built to move toner, and the highest voltage at which acceptable printing still occurs before Paschen breakdown causes undesirable print artifacts. This difference, called a transfer window, varies across environments as the receiving media varies in its properties over those same environments. The larger the difference between these two voltages, the more latitude the imaging device design has for part to part variation and still yield good quality prints.

The low end of the transfer window is determined by how well the electric field (measured in Volts/meter) can be established, and how much electric field is then required to overcome the forces of adhesion between the toner and the donating media. The high end of the transfer window is the point at which the electric field built to move the toner exceeds the Paschen limit, the limit at which the dielectric properties of the materials in the transfer nip will begin to discharge and conduct significantly more current. Breakdown almost always happens in the air gaps of the imaging device nip. Electrostatic discharge after the nip is the least severe of these as the result is to add charge to toner already transferred which might make future transfer steps more difficult. Electrostatic discharge in the nip or before the nip can cause reversal of charge on toner or movement of toner which will show up as a print defect. Thus, depending on the location of the breakdown, various print defects will likely be present in the page, which would make the print unacceptable.

Many modifications have been made to transfer systems to increase the field strength during transfer to improve transfer efficiency and print quality. These modifications include larger nip widths, increased force (pressure) in the nip and pre-wrap to bring transferring members together prior to field increase. All of these improvements have made print quality significantly better in current color (multi-toner-layer) EP imaging devices however some issues remain. Imaging devices also tend to get too much non-uniform electric field in the transfer nip which causes the system to go into overtransfer pre-maturely. This means that print quality degrades significantly, and so operating windows are compressed or disappear.

Thus, there is still a need for an innovation that will address the specific problem of overtransfer in a non-uniform electric field conditions or high conductivity conditions.

SUMMARY OF THE INVENTION

The present invention, which is concerned with the aforementioned high end of the transfer window, meets this need by providing an innovation in which a thin polymer coating layer with high dielectric breakdown strength is applied to a transfer nip defining element in an imaging device for improved overtransfer performance. The coating is applied as a surface layer to one of the elements at the transfer nip. In such manner it will prevent premature Paschen breakdown and increase transfer window size by increasing the electrical voltage at which overtransfer related defects occur and therefore transfer robustness, thereby increasing the operating window. Such layer of thin polymer coating needs to be applied to one or more elements at the transfer nip that can bleed off electrical charge build up as the layer is used as a boundary to current flow and not as a capacitor itself. Such element(s) may be the outer surface of a backup or transfer roll or the inside surface of the transfer or transport belt having a specified range of surface resistivity. The high dielectric breakdown strength of such layer of thin polymer coating is determined by its thickness and material composition.

Accordingly, in an aspect of the present invention, a method for enlarging a transfer window for toner transfer in an EP imaging device, wherein toner is moved from a donating medium to an accepting medium, includes applying a layer of a thin polymer coating to an element of a donating medium located at a toner transfer nip wherein the polymer layer has a thickness from about 5 μm to about 200 μm, a surface resistivity from about 1E08 to about 1E12 Ohm/cm and a breakdown strength greater than 500 V.

In another aspect of the present invention, a transfer station for toner transfer in an electrophotographic imaging device includes an endless transfer belt transported about an endless path through the imaging device, a transfer roll adjacent one surface of the transfer belt, a transfer roll adjacent one surface of said transfer belt, a backup roll adjacent an opposite surface of the transfer belt opposite from the transfer roll such that the transfer roll and backup roll form a transfer nip effecting transfer of toner; and an outer layer of a thin polymer coating applied to at least one of the transfer belt and the rolls so as to be located within the transfer nip with transfer of toner, the polymer layer having a thickness from about 5 μm to about 200 μm, a surface resistivity from about 1E08 to about 1E12 Ohm/cm and a breakdown strength greater than 500 V.

BRIEF DESCRIPTION OF THE DRAWINGS

Figure 1:
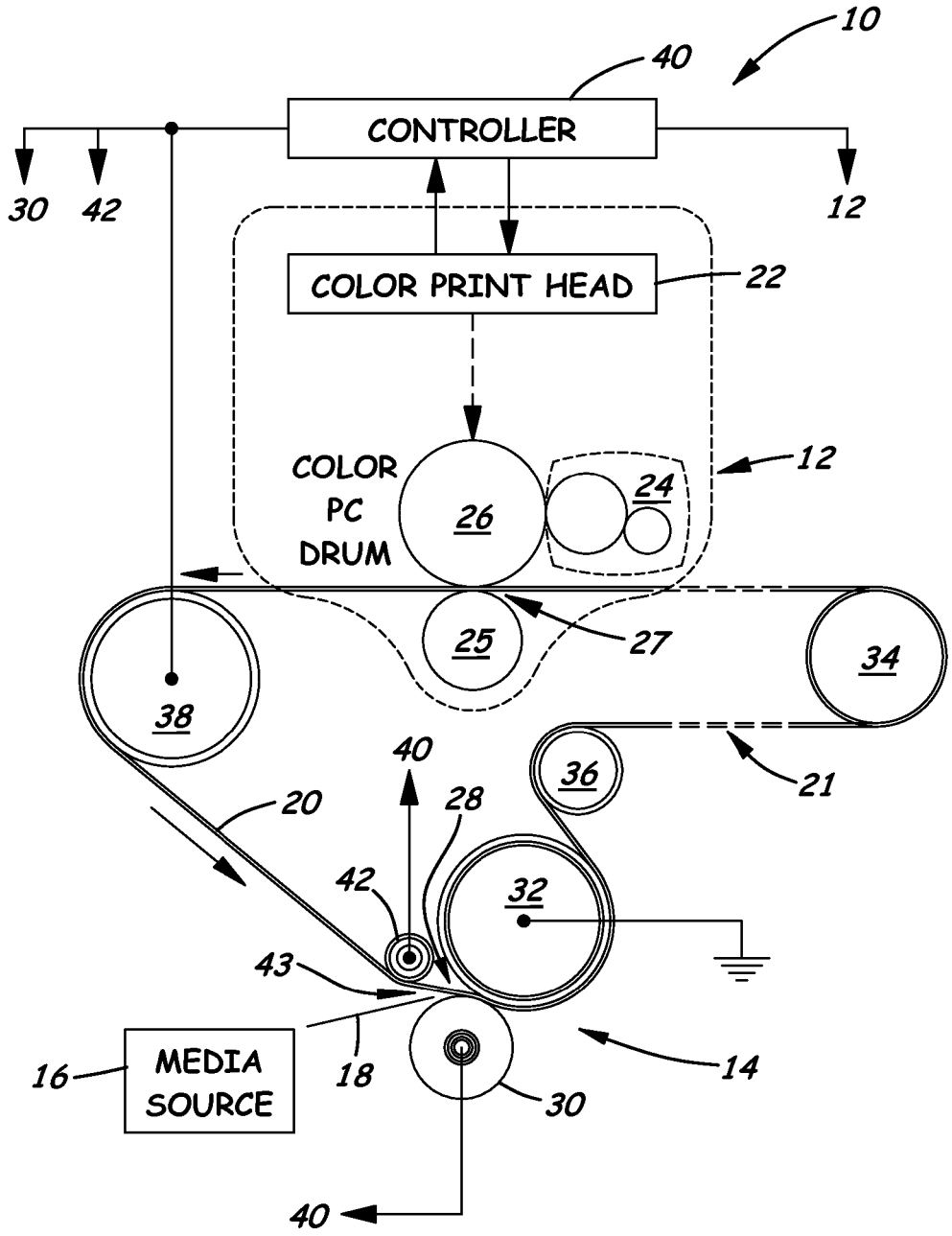

Having thus described the invention in general terms, reference will now be made to the accompanying drawings, which are not necessarily drawn to scale, and wherein:

FIG. 1 is a simplified partial schematic representation of an exemplary color EP imaging device having the various elements at the transfer nip to one or more of which the layer of thin polymer coating may be applied in accordance with the present invention.

Figure 2:
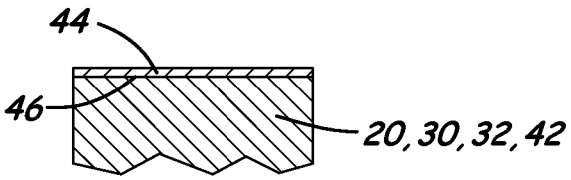

FIG. 2 is an enlarged fragmentary cross-section of any of the one or more elements at the transfer nip in the EP imaging device of FIG. 1 having the layer of thin polymer coating applied thereon.

DETAILED DESCRIPTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numerals refer to like elements throughout the views.

Referring to FIG. 1, there is schematically illustrated in simplified form an exemplary embodiment of a color EP imaging device 10 to which the present invention may be applied. The imaging device 10 is a two transfer system which includes, in part, a plurality of first transfer color imaging forming stations 12 (only one being shown), a second transfer station 14, a media source 16 for feeding one at a time a media sheet 18 of paper, for instance, to the second transfer station 14, and an intermediate transfer member (ITM) belt 20 arranged to be moved along an endless path 21 that passes through the first and second stations 12, 14. By way of example, the color image forming stations 12 may provide respectively image layers having the colors, yellow (Y), cyan (C), magenta (M), and black (K). Each of the color image forming stations 12 includes a print head 22, a developer assembly 24, a first transfer roll 25, a photoconductive (PC) drum 26, and a first transfer nip 27 between the first transfer roll 25 and the PC drum 26. The print head 22 forms a latent image on the PC drum 26 in a manner known in the art. Toner (not shown) is supplied to the PC drum 26 by the developer assembly 24 to produce a toned partial image, known as a color separation or layer, from the latent image on the PC drum 26.

The color partial image layer produced at each of the first transfer stations 12 is transferred to the ITM belt 20 such that a composite color image accumulates thereon and then is transferred to the print medium, the media sheet 18, at the second transfer station 14 at a second transfer nip 28 defined between a second transfer roll 30 and a backup roll 32 positioned at the second transfer station 14. Both the media sheet 18 and ITM belt 20 pass through the second transfer nip 28 in contact with one another to enable the transfer of the composite color image to the media sheet 18 from the ITM belt 20. The ITM belt 20 wraps partially about each of the second transfer roll 30 and the backup roll 32 such that they are counter-rotated relative to one another by their respective contacts with the ITM belt 20. Also in FIG. 1, there is shown guide rollers 34, 36 located downstream of the second transfer station 14 and a drive roller 38 located upstream thereof. The imaging device 10 also includes a suitable controller 40 that controls all operations. The second transfer roll 32 is powered with, for example, a positive voltage from the controller 40. Further details of the conventional operations of the imaging device 10 as described above may be gained from U.S. Pat. No. 6,363,228, assigned to the assignee of the present invention, the disclosure of which is hereby incorporated herein by reference.

Also, the second transfer station 14 may include a pre-nip roll 42 located upstream of the second transfer nip 28 formed between the second transfer roll 30 and the backup roll 32. The pre-nip roll 42 is configured and positioned to control the entrance geometry, as seen in FIG. 1, of a gap 43 between the ITM belt 20 with toner (not shown) thereon and the media sheet 18 onto which the toner will be transferred, for tailoring the electric field of the second transfer nip 28 for enhanced toner transfer in diverse environments of temperature and humidity.

In accordance with present invention, referring now to FIGS. 1 and 2, a layer 44 of a thin polymer coating is attached to a selected one or more elements of the donating medium in a transfer nip, such as second transfer nip 28, that can bleed off electrical charge build up as the layer 44 is used as a boundary to current flow and not as a capacitor itself. As seen in FIG. 2, a suitable location to place this polymer coating layer 44 includes on an outer surface 46 of metal rolls 30, 32, 42 and/or on the inside surface 46 of the transfer or transport belt 20 whose surface resistivity is from about 1E08 to about 1E12 Ohm/cm, but preferably from about 1E09 to about 1E10 Ohm/cm. Ideally the polymer coating layer 44 should be thin so as not to add significantly to the resistance of the transfer nip. Additional resistivity will move to a higher voltage, the point at which over-transfer occurs, but it does not increase the net window size nor does it make it easier to get the transfer window to come in with a limited power supply. Since adding additional material thickness will increase the resistivity, there will be a tradeoff between thickness and dielectric strength. Current thin layer polymer materials have a volume resistivity of 1E13 to 1E15 Ohm/cm, making a thin layer requirement and a 20-50 μm thick layer as the preferred embodiment. The thin layer dielectric breakdown strength is greater than 500V and the thickness of the thin layer should be optimized to reduce the impact of the added resistance while maximizing dielectric breakdown strength. The polymer layer should be uniform and smooth, with no voids or holes in the layer through which current can pass.

Teflon or other fluoropolymers, polyester polyurethane or other suitable polyurethanes, polypropylene, polyethylene, PFA, PVC, PET and other polyesters can be used as the thin polymer coating material. The thickness of such materials range approximately from about 5 μm to 200 μm, with the tradeoff being between the dielectric strength of the material and the added resistance in the transfer nip. Added resistance means that more energy will be required to get good transfer and is less efficient.

When the receiving media is very conductive, electrical charge migration might work adversely with the dielectric layer and produce over transfer artifacts in print. This can be overcome by insuring that electrical charge migration is minimized by proper geometric and power designs as disclosed in the first cross-reference patent application whose disclosure is incorporated herein by reference. This disclosure also mentions the importance of isolating the paper in hot/wet environments to reduce lateral conduction to the imaging device through the paper. This is even more important when implementing a dielectric layer for overtransfer protection.

Toner is composed of fine particles of polymers such as styrene and polyester with pigments and waxes coated with small silicas and other additives. These particles, which range in diameter from less than a micron to over 20 μm, but typically 6-8 μm, are charged in a typical print cartridge system and developed onto patterned areas in the PC drum 26. These charged toner particles are brought into the first transfer nip 27 by the PC drum 26, or in the case of the second transfer nip 28 in the two transfer system, as shown in FIG. 1, by the ITM belt 20. The toner on either the PC drum 26 or the ITM belt 20 is by nature of the patterning effect uneven in charge distribution and uneven in height. Additionally, other layers or patterned toner from previous transfer stations will add to the charge height and charge variations.

The purpose of the transfer nip 27, 28 in an EP imaging device 10 is to bring the toner donating member and the toner receiving member into close proximity so that a strong enough electrical field can be built to cause the toner to detach from the donating member and reattach on the receiving member. The strength of that force is the product of the charge on the toner and the strength of the field. The opposing force is the force of adhesion which is generally considered to be Van der Waals forces of attraction.

When in close proximity, air gaps between layers are small. The field required to push electrons through an air gap (Paschen discharge) increases as the gap decreases. The nip now acts like a capacitor with an electric bias across it and minimal current flow. Toner transferring from donating to receiving member does take electrical charge with it and represents a measurable electrical current flow. Electrical current flow in excess of that amount is undesirable.

EP imaging making, such as printing, is not a stagnant or batch process; rather toner and receiving and donating media are constantly flowing into and out of the nip area. For this reason, the nip is composed of rolls or belts that can move with the toner and media from the separated state, through the close proximity region and into the separated state again. The process speed determines how quickly the materials in the system need to be able to conduct electrical charge and build an electric field. If the electric field builds too quickly there will be Paschen discharge in the before-nip area and print defects will result. If the electric field builds too slowly, there may not be enough electric field in the nip to actually move the toner. The time constant of the system is normally controlled by controlling the resistance and capacitance of the materials chosen for the nip.

In an exemplary embodiment, as seen in FIG. 1 in a two transfer EP process, the polymer layer 44 is placed on an underside 46 of the transfer belt 20. Preferably, the layer 44 is placed on the inside of the belt 20 so as not to inhibit the releaser properties of the belt or cleaning of the belt. Electrical charge build up is prevented by contact between the belt 20 and the layer 44 and the moderately conductive nature of the belt 20. It may be necessary to pass a non-printing area of the belt under a grounded element, or equivalent design feature. Metal transfer rolls, such as second transfer roll 30 and backup roll 32, use the resistivity of the belt 20 to build an electric field to transfer toner. In this embodiment the high dielectric breakdown strength layer 44 also prevents carbon tracking by preventing arcing between the roll and the belt. This will be true whether the layer 44 is located on the inside of the belt 20 or on the metal transfer rolls 30, 32, 42. The polymer layer 44 should not be located on all four elements 20, 30, 32, 42 but is most useful if it is used on one or two elements not directly touching another polymer layer of the present invention.

In this embodiment the transfer nip 28 brings toner, donating and receiving media into close proximity in the nip. The bias applied to the core of the transfer roll or by corona or blade or other device on the back of the transfer media would cause an electric field to build in the nip area. The electric field will pull on all electrical charges, both those on the toner and those in the air and other materials. These electrons will attempt to move until they reach a dielectric barrier where they will build up. The electrons on the toner will cause it to be pulled onto the receiving media. Electrons elsewhere will continue to build at dielectric boundaries.

If the build of electrical charge at these boundaries exceeds the dielectric strength of that boundary then the electrons will flow through it to the next boundary and build up. One of those boundaries will be across the air gaps present between layers in the transfer nip. If the build up exceeds the dielectric breakdown strength of air (the Paschen limit) current will find a path through the ionized air. A high dielectric strength layer 44 prevents the movement of the non-toner related electrons through the nip. This prevents them from building up at and overpowering air gaps. In this way, toner will be able to move in the built up electric field, but the electrical voltage needed to create the undesirable discharge events will be increased, enlarging the operating window for the system.

According to the present invention, therefore, adding a thin polymer layer 44 with high dielectric breakdown strength to selected elements at the transfer nip increases the voltage at which over transfer related defects occur. The result is an inexpensive way to improve transfer quality in those situations where premature overtransfer can limit operating windows. Such conditions can exist in many normal printing scenarios such as a hot/wet environment, printing at slower printing speeds, using rougher media, a scenario with a mixture of multilayered solid toners and thin halftones in the same area of the page, or using worked chemically prepared toner (CPT). In these situations a thin polymer layer with a high dielectric breakdown strength applied in one of several places will achieve the same result, which is to improve system performance at minimal additional cost or space.

While the present invention is described above using a two transfer EP printing process, the present invention is also understood to be useful in any direct to paper printing process that is well known in the prior art. Specifically, the present invention applies to any transfer process whereby toner is moved from a donating medium, like the PC drum 26 or the transfer belt 20, to an accepting medium.

The foregoing description of several embodiments of the invention has been presented for purposes of illustration. It is not intended to be exhaustive or to limit the invention to the precise forms disclosed, and obviously many modifications and variations are possible in light of the above teaching. It is intended that the scope of the invention be defined by the claims appended hereto.

What is claimed is:

1. A method for enlarging a transfer window in an electrophotographic imaging device for toner transfer, comprising:

providing at an element associated with a transfer nip of the electrophotographic imaging device, said element including a layer of a polymer coating, wherein said polymer coating layer has a thickness from about 5 μm to about 200 μm, a surface resistivity from about 1E08 to about 1E12 Ohm/cm and a breakdown strength greater than 500 V, wherein said element comprises a back-up roll, and wherein said polymer coating layer is disposed on an outer surface of said back-up roll.

2. The method according to claim 1 wherein said back-up roll is made of a suitable conductive material.

3. The method according to claim 1 further comprising providing a transfer roll associated with said transfer nip and having said polymer coating layer disposed on an outer surface of said transfer roll.

4. The method according to claim 1 wherein said polymer coating layer is comprised of a material selected from the group consisting of a fluoropolymer polyester polyurethane, polypropylene, polyethylene, PFA, PVC, and PET.

5. A transfer station for toner transfer in an electrophotographic imaging device, comprising:

an endless transfer belt transported about an endless path through said imaging device;

a transfer roll adjacent one surface of said transfer belt;

a backup roll adjacent an opposite surface of said transfer belt opposite from said transfer roll such that said transfer roll and backup roll form a transfer nip effecting transfer of toner; and an outer layer of a thin polymer coating disposed on at least one of said transfer belt, said transfer roll and said backup roll so as to be located within said transfer nip with transfer of toner, said polymer coating outer layer having a thickness from about 5 μm to about 200 μm, a surface resistivity from about 1E08 to about 1E12 Ohm/cm and a breakdown strength greater than 500 V, wherein said layer is disposed on said backup roll.

6. The transfer station according to claim 5 further comprising a pre-nip roll located adjacent said opposite surface of said transfer belt upstream of said transfer nip.

7. The transfer station according to claim 6 where said polymer coating outer layer is disposed on said pre-nip roll.

8. The transfer station according to claim 5 wherein said polymer coating outer layer is applied to said transfer roll.

9. The transfer station according to claim 5 wherein said polymer coating outer layer is comprised of a material selected from the group consisting of a fluoropolymer, polyester polyurethane, polypropylene, polyethylene, PFA, PVC, and PET.

10. An electrophotographic imaging device, comprising:

at least one image-forming first transfer station having a first transfer nip;

a second transfer station having a second transfer nip;

an endless transfer belt transported in an endless path passing, first, through said first transfer nip at said first transfer station where toner forming an image is deposited on said transfer belt and, second, into and through said second transfer nip of said second transfer station where the toner is transferred from said transfer belt onto a media sheet;

said second transfer station including a transfer roll adjacent to one surface of said transfer belt, a backup roll adjacent to an opposite surface of said transfer belt and forming said second transfer nip with said transfer roll for effecting toner transfer in said second transfer nip, and an outer layer of a thin polymer coating disposed on said backup roll so as to be located within said second transfer nip with transfer of toner, said polymer coating outer layer having a thickness from about 5 μm to about 200 μm, a surface resistivity from about 1E08 to about 1E12 Ohm/cm and a breakdown strength greater than 500 V.

11. The imaging device according to claim 10 further comprising a pre-nip roll located adjacent said opposite surface of said transfer belt upstream of said transfer nip, said polymer coating outer layer being disposed on said pre-nip roll.

12. The imaging device according to claim 10 wherein said polymer coating outer layer is comprised of a material selected from the group consisting of a fluoropolymer, polyester polyurethane, polypropylene, polyethylene, PFA, PVC, and PET.

13. A transfer station for toner transfer in an electrophotographic imaging device, comprising:

an endless transfer belt transported about an endless path through said imaging device;

a transfer roll adjacent one surface of said transfer belt;

a backup roll adjacent an opposite surface of said transfer belt opposite from said transfer roll such that said transfer roll and backup roll form a transfer nip effecting transfer of toner;

a pre-nip roll located adjacent said opposite surface of said transfer belt upstream of said transfer nip; and an outer layer of a thin polymer coating disposed on at least one of said backup roll and said pre-nip roll, said polymer coating outer layer having a thickness from about 5 μm to about 200 μm, a surface resistivity from about 1E08 to about 1E12 Ohm/cm and a breakdown strength greater than 500 V.

* * * * *